US008492711B2

(12) United States Patent
Kinugawa et al.

(10) Patent No.: US 8,492,711 B2
(45) Date of Patent: Jul. 23, 2013

(54) MULTI-TURN TIME-OF-FLIGHT MASS SPECTROMETER

(75) Inventors: Tohru Kinugawa, Osaka (JP); Osamu Furuhashi, Uji (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 13/289,908

(22) Filed: Nov. 4, 2011

(65) Prior Publication Data

US 2012/0112060 A1 May 10, 2012

(30) Foreign Application Priority Data

Nov. 5, 2010 (JP) ..... 2010-248197

(51) Int. Cl.
*H01J 49/00* (2006.01)

(52) U.S. Cl.
USPC ..... 250/287; 250/281; 250/282; 250/288

(58) Field of Classification Search
USPC ..... 250/281, 282, 287, 288
See application file for complete search history.

(56) References Cited

U.S. PATENT DOCUMENTS

| | | | | |
|---|---|---|---|---|
| 6,949,736 | B2 | 9/2005 | Ishihara | |
| 7,091,480 | B2 | 8/2006 | Yamaguchi et al. | |
| 8,258,467 | B2 * | 9/2012 | Kajihara | 250/287 |
| 2009/0272890 | A1 * | 11/2009 | Ogawa et al. | 250/281 |
| 2010/0258716 | A1 * | 10/2010 | Yamaguchi | 250/287 |
| 2010/0282965 | A1 | 11/2010 | Nishiguchi et al. | |
| 2011/0192972 | A1 * | 8/2011 | Furuhashi et al. | 250/287 |
| 2011/0215239 | A1 * | 9/2011 | Yamaguchi | 250/287 |
| 2011/0248161 | A1 * | 10/2011 | Takeshita et al. | 250/287 |

FOREIGN PATENT DOCUMENTS

| | | | |
|---|---|---|---|
| JP | 2005079049 | A | 3/2005 |
| JP | 2005116343 | A | 4/2005 |
| WO | 2009075011 | A1 | 6/2009 |
| WO | WO 2010052756 | A1 * | 5/2010 |

OTHER PUBLICATIONS

Nishiguchi et al., "Novel Multi-Turn Mass Spectometry with Multi-Turn Ion Optical Systems" Shimadzu Review, vol. 66, Nos. 1 and 2, pp. 61-72, Sep. 30, 2009 (with English abstract).

Nishiguchi et al., "Design of a new multi-turn ion optical system 'IRIS' for a time-of-flight mass spectrometer" J. Mass Spectrom. vol. 44, pp. 594-604.

* cited by examiner

*Primary Examiner* — Michael Maskell
(74) *Attorney, Agent, or Firm* — Bingham McCutchen LLP

(57) ABSTRACT

A multi-turn time-of-flight mass spectrometer creates, an accurate mass spectrum of a wide mass range, with the smallest number of measurements. Deflecting electrodes are provided on an ejection path through which ions deviating from a loop orbit fly to a detector having two-dimensional array elements. A varying voltage applied to the deflecting electrodes creates an electric field. When two ions having different mass-to-charge ratios simultaneously arrive at the detector, these ions are affected with differing strengths since they pass through the deflecting electric field at different times. This results in arrival for the ions on a detection surface. The time an ion passing through the deflecting electric field can be calculated from the displacement of the arrival position of that ion. Then the flight speed of the ion is obtained and its number of turns is roughly deduced to arrive at its mass-to-charge ratio.

11 Claims, 5 Drawing Sheets

MULTI-TURN TIME-OF-FLIGHT MASS SPECTROMETER

TECHNICAL FIELD

The present invention relates to a multi-turn time-of-flight mass spectrometer in which ions originating from a sample are made to repeatedly fly along a closed loop orbit to separately detect them according to their mass-to-charge ratio (m/z).

BACKGROUND ART

A time-of-flight mass spectrometer (hereinafter abbreviated as TOFMS) is a type of device used for measuring the time of flight required for each ion to travel a specific distance and converting the time of flight to the mass-to-charge ratio to create a mass spectrum. This is based on the principle that ions accelerated by a certain amount of energy will fly at different speeds corresponding to their mass-to-charge ratio. Accordingly, elongating the flight distance of the ions is effective for enhancing the mass resolving power. However, elongating the flight distance along a straight line requires enlarging the device. To solve this problem, multi-turn time-of-flight mass spectrometers (hereinafter abbreviated as MT-TOFMS) have been developed, in which ions are made to repeatedly fly along a closed orbit having a substantially circular shape, substantially elliptical shape, substantially figure-"8" shape or other shape in order to simultaneously achieve both the elongation of the flight distance and the downsizing of the apparatus.

Another type of device developed for the same purpose is the multi-reflection time-of-flight mass spectrometer, in which the aforementioned loop orbit is replaced by a reciprocating path in which a reflecting electric field is created to make ions fly back and forth multiple times and thereby elongate their flight distance. Although the multi-turn time-of-flight type and the multi-reflection time-of-flight type use different ion optical systems, they are essentially based on the same principle for improving the mass resolving power and are intended for addressing the same problem. Accordingly, in the present description, the "multi-turn time-of-flight type" should be interpreted as inclusive of the "multi-reflection time-of-flight type."

As previously described, MT-TOFMSs can achieve a high level of mass-resolving power by elongating the flight distance. However, they have a drawback due to the fact that the flight path of the ions is a closed orbit. That is, as the number of turns of the ions increases, an ion having a smaller mass-to-charge ratio and flying at a higher speed overtakes another ion having a larger mass-to-charge ratio and flying at a lower speed. If such an overtaking of ions having different mass-to-charge ratios occurs, the obtained time-of-flight spectrum will have a mixture of peaks originating from the ions that have undergone different numbers of turns. That is to say, it is possible that the flight distance of the ion corresponding to one peak differs from that of the ion corresponding to another peak. This means it is no longer ensured that the mass-to-charge ratio and the flight distance uniquely correspond to each other, so that the time-of-flight spectrum cannot be directly converted to a mass spectrum.

To address the aforementioned drawback, in many conventional MT-TOFMSs, the ions originating from a sample generated in an ion source are subjected to an ion-filtering process beforehand (i.e. before being introduced into the loop orbit) to select only a group of ions belonging to a mass-to-charge ratio range where the aforementioned overtaking will not occur. The selected ions are made to fly along the loop orbit to undergo a predetermined number of turns and then be detected. Although a mass spectrum with a high mass resolving power can be obtained with such a method, the mass-to-charge ratio range of the obtained mass spectrum is significantly limited. This is contrary to the advantage of TOFMSs that a mass spectrum with a relatively wide mass-to-charge ratio range can be obtained by one cycle of measurement.

To address such problems, various methods have been proposed for creating a mass spectrum from a time-of-flight spectrum obtained by a measurement even if the overtaking of ions occurs during their flight in the loop orbit.

For example, Patent Document 1 discloses a method in which a plurality of time-of-flight spectra for different periods of time for ejection of the ions from the orbit are obtained for a target sample and then a time-of-flight spectrum of a single turn is reconstructed using a multi-correlation function of the plural different time-of-flight spectra. The "period of time for ejection of an ion" is generally the amount of time from the point in time when the ion is ejected from an ion source until the point in time when the ion is made to deviate from the loop orbit after passing through this orbit. Hereinafter, this will be simply referred to as the "ion ejection time." With this method, obtaining a mass spectrum substantially in real time while performing the measurement is almost impossible because of the large amount of computation of the multi-correlation function, which requires considerable computing time. Furthermore, if a significantly large number of peaks appear on the time-of-flight spectra, the amount of computation becomes enormous. In such a case, it is difficult to obtain the result of computation in a practically acceptable length of time if a general-purpose personal computer is used.

Another type of method for obtaining a mass spectrum is described in Patent Document 3, as well as Non-Patent Documents 1 and 2. In this method, a time-of-flight spectrum for a target sample is obtained in a linear mode in which ions injected into the apparatus are ejected without flying through a closed loop orbit. (A time-of-flight spectrum obtained in this mode is hereinafter called the "zero-turn time-of-flight spectrum.") Then, the number of turns and the time of flight in a multi-turn mode, in which an ion may overtake another ion, are predicted from the time of flight of the peaks on the zero-turn time-of-flight spectrum. Based on this prediction, time-of-flight segments, whose widths are determined by considering the time spread of the peaks, are set on the time-of-flight spectrum in the multi-turn mode. Since the peaks included in one segment originate from ions with the same number of turns, the number of turns and the mass-to-charge ratio of all the peaks can be uniquely determined if no adjacent segments overlap each other. Hence, the existence of the overlapping of the segments which are set on the time-of-flight spectrum in the multi-turn mode is judged to search for a condition under which the overlapping does not occur and to fix the segment setting. Since this determines the optimal ejection time when ions should be ejected from the loop orbit, a measurement in the multi-turn mode is performed by controlling the timing for switching the gate electrode for ejecting ions based on this optimal ejection time. Then, a mass spectrum is created from the time-of-flight spectrum obtained as a result of this measurement.

The data processing used in this method is relatively simple and can be performed in almost real time even by a general-purpose personal computer. However, this method is disadvantageous in that the mass spectrum cannot be created if the number of peaks to be observed is so large that no condition to avoid the overlapping of the segments can be found. When the sample to be analyzed is a protein, sugar chain or similar substance, it is anticipated that the segments often overlap. Accordingly, the cases in which this method can be used are significantly limited. Limiting the range of mass-to-charge ratio of the ions introduced into the loop orbit may be another approach to prevent the segments from overlapping. However, this deteriorates the measurement throughput.

Patent Document 2 discloses a method for deducing the mass-to-charge ratio of a target ion by a process including the steps of: obtaining a plurality of time-of-flight spectra of a target sample with different ion ejection times; calculating possible candidates for the mass-to-charge ratio of the target ion by assuming the number of turns for each peak on each of the time-of-flight spectra; and locating a candidate of the mass-to-charge ratio that has been commonly selected on all the time-of-flight spectra.

The data processing used in this method is also relatively simple and can be performed in almost real time with a general-purpose personal computer. Finding the correspondence relationship of the peaks between the different time-of-flight spectra is easy for a small number of peaks. However, this relating process becomes complicated when the number of components contained in the sample is large and the number of peaks appearing on the time-of-flight spectra is accordingly large. Having a large number of peaks also means a high probability of erroneous deduction of the mass-to-charge ratio; that is to say, a mass-to-charge ratio that is actually unrelated to the target ion may accidentally satisfy the conditions of the deduction. Furthermore, the peaks originating from ions having different mass-to-charge ratios become more likely to accidentally overlap each other on a time-of-flight spectrum, which prevents accurate deduction of the mass-to-charge ratio.

BACKGROUND ART DOCUMENT

Patent Document

Patent Document 1: JP-A 2005-79049
Patent Document 2: JP-A 2005-116343
Patent Document 3: WO-A1 2009/075011

Non-Patent Document

Non-Patent Document 1: Nishiguchi, et al. "Tajuu Shuukai Ion Kougakukei Niyoru Atarashii Tajuu Shuukai shitsruryou Bunseki Hou," ("Novel Multi-Turn Mass Spectrometry with Multi-Turn Ion Optical Systems") *Shimadzu Review*, vol. 66, Nos. 1 and 2, published on Sep. 30, 2009

Non-Patent Document 2: Nishiguchi, et al. "Design of a new multi-turn ion optical system 'IRIS' for a time-of-flight mass spectrometer," *J. Mass Spectrom.*, 44 (2009), p. 594

DISCLOSURE OF THE INVENTION

Problem to be Solved by the Invention

As previously described, each of the conventional methods for constructing a mass spectrum from time-of-flight spectrum data obtained with an MT-TOFMS has both advantages and disadvantages. Particularly, each of the conventional methods has either the problem that the correct mass spectra cannot be easily obtained when the sample to be analyzed contains a large number of components and hence a large number of peaks appearing on the time-of-flight spectrum, or the problem that a large number of time-of-flight spectra obtained by analyzing the same sample under different conditions are required to obtain a mass spectrum for one sample. In either of these cases, the measurement throughput becomes inevitably low. Furthermore, such methods consume a large amount of the sample and are unsuitable for analyzing a rare and expensive sample.

The present invention has been developed to solve the aforementioned problems. Its primary objective is to provide a multi-turn time-of-flight mass spectrometer capable of obtaining an accurate mass spectrum over a broad range of mass-to-charge ratio by using the analysis result obtained by only one or a small number of measurements, thus improving the throughput of the measurement or reducing the amount of the consumed sample.

Means for Solving the Problems

The present invention aimed at solving the aforementioned problem is a multi-turn time-of-flight mass spectrometer for determining a mass-to-charge ratio of an ion from a time of flight of the ion by ejecting ions in a pulsed fashion from an ion source, introducing the ejected ions into a loop-orbit section to make the ions repeatedly fly along a substantially identical orbit a plurality of times, detecting each of the ions deviated from the loop-orbit section, and determining the time of flight of the detected ion, the mass spectrometer including:

a) a deflecting electrode unit located on a path extending from a point at which the ions deviate from the loop-orbit section to a below-mentioned ion detector;

b) a voltage generator for applying a temporally varying voltage to the deflecting electrode unit to create an electric field having an effect of shifting an ion in a direction orthogonal to an incident direction of the ions entering the deflecting electrode unit;

c) an ion detector for providing at least positional information indicating an arrival position of the ion in the direction in which the ion is shifted by the electric field created by the deflecting electrode unit, and temporal information indicating an arrival time of the ion; and d) a data processor for deducing a number of turns made by an ion in the loop-orbit section, based on the positional information indicating the arrival position of the ion at the ion detector and the temporal information indicating the arrival time of the ion, and for calculating the mass-to-charge ratio of the ion by using information indicating the deduced number of turns.

The ion detector may be a single detector or a one-dimensional or two-dimensional array of detectors as long as it can provide the positional information indicating the arrival position of the ion in the direction in which the ion is shifted by the electric field created by the deflecting electrode unit and the temporal information indicating the arrival time of the ion.

In the multi-turn time-of-flight mass spectrometer according to the present invention, while ions are flying in substantially the same orbit of the loop-orbit section, some ions having smaller mass-to-charge ratios and flying at higher speeds overtake other ions having larger mass-to-charge ratios and flying at lower speeds. Therefore, when the ions are on the path deviating from the loop-orbit section to the ion detector, they fly no longer in order of mass-to-charge ratio. These ions also vary in the number of turns; i.e. they undergo various numbers of turns in the loop-orbit section. The electric field created by applying the temporally varying voltage from the voltage generator to the deflecting electrode unit does not affect the motion of ions in their travelling direction. This means that this electric field does not influence their time of flight, which is defined, for example, as the length of time between the point where an ion is ejected from the ion source and the point where this ion arrives at the ion detector.

The arrival position of an ion on the detection surface of the ion detector changes depending on the strength and direction of the electric field at the point in time when the ion passes through the deflecting electrode unit. If there are two kinds of ions having different mass-to-charge ratios, each ion will have a different flight speed and different flight time from the point in time when the ions pass through the deflecting electrode unit to the point in time when they arrive at the detection surface of the ion detector. Accordingly, for each ion arriving at the detection surface of the ion detector, the data processor deduces the point in time when the ion has passed through the deflecting electrode unit based on the positional information and the temporal information received from the ion detector. The positional information is the amount of displacement of the ion (i.e. the amount of shift from the position at which the ion should arrive if there is no deflecting electric field), while the temporal information is the timing of the temporal change in the voltage produced by the voltage generator. The flight speed of the ion is also roughly estimated from the difference between the point in time when the ion passed through the deflecting electrode unit and the point in time when the ion arrived at the ion detector, and the structurally determined distance from the deflecting electrode unit to the ion detector. The number of turns of the ion is deduced from the roughly estimated flight speed, and the actual flight distance of the ion is calculated from the deduced number of turns. Using the time of flight and the flight distance thus obtained, an accurate mass-to-charge ratio can be calculated.

By similarly deducing the number of turns for every ion that has arrived at the ion detector and calculating its mass-to-charge ratio from the deduced number of turns, it is possible, for example, to obtain a mass spectrum from the time-of-flight spectrum of the ions that have arrived at the ion detector. However, in some cases, a portion of the ions may be lost before reaching the ion detector due to the influence of a gate electrode used for deflecting ions from the loop-orbit section. Even in such cases, it is normally possible to compensate for the loss of the ions and create a complete mass spectrum by performing the measurement two times under different analysis conditions and combining the results of the two measurements.

As already explained, ions produced in a time-of-flight mass spectrometer are given the same amount of energy, irrespective of whether their mass-to-charge ratios are the same or different. This also applies to the time-of-flight mass spectrometer according to the present invention. Therefore, if the electric field created by the deflecting electrode unit is temporally constant, all the ions will arrive at the same point on the surface of the ion detector. In contrast, if the electric field created by the deflecting electrode unit changes with time, the point of arrival of the ions also changes with time, describing a linear or curved locus. Making this locus longer improves the accuracy of deducing, from the positional information, the point in time when an ion passes through the deflecting electrode unit. Accordingly, in one preferable mode of the present invention, the deflecting electrode unit includes two sets of electrodes capable of deflecting an ion in two directions orthogonal to each other as well as orthogonal to an incident direction of the ion entering the deflecting electrode unit, the voltage generator applies a temporally varying voltage to each of the two sets of electrodes, and the ion detector includes a plurality of detector elements which are two-dimensionally arrayed in the aforementioned two directions.

The detector elements are micro-sized detectors which have substantially the same shape, operate on the same detection principle, and have the same actions and functions to detect ions, particles or the like, where each detector element can provide information about the detection time or the amount of the detected ions but cannot provide information for locating the detection point within itself. A device composed of a one-dimensional or two-dimensional array of such detector elements and a means for providing positional information indicating the location of a detector element receiving an ion can operate and function as the ion detector of the present invention. One example of the detector element is electron multiplier tube. A micro-channel plate (MCP) having an array of electron multiplier tube combined with delay-line anodes can operate and function as the ion detector of the present invention.

In the aforementioned preferable mode of the present invention, it is further preferable to configure the voltage generator so that it generates two voltages whose waveforms temporally vary with different periods, and applies the voltages to the two sets of the deflector electrodes, respectively.

In the aforementioned mode, the point of arrival of an ion on the detection surface can be determined in two directions (e.g. in the X and Y directions) orthogonal to each other. This increase in the amount of information enables more accurate deduction of the point in time when an ion passes through the deflecting electrode unit, thereby improving the deduction accuracy of the flight speed of the ion and hence its number of turns.

In the multi-turn time-of-flight mass spectrometer according to the present invention, the ion source is not necessarily an original generator of the ions. For example, it may be an ion trap or similar device which temporarily holds externally generated ions and simultaneously gives energy to all the ions to eject them in a pulsed fashion (in the form of a packet). There is no specific limitation on the shape of the loop orbit used in the loop-orbit section; a reflecting orbit for making ions fly back and forth is also one type of the loop orbit.

Effect of the Invention

The multi-turn time-of-flight mass spectrometer according to the present invention solves a typical problem of this kind of device, i.e. the overtaking of ions having different mass-to-charge ratios, and thereby makes it possible to create a highly accurate mass spectrum over a broad range of mass-to-charge ratio by using a result obtained by one or a small number of measurements performed for the same sample. Therefore, it is unnecessary to perform a large number of measurements. This is advantageous for improving the measurement throughput. Furthermore, even when an expensive sample is used, the cost of the measurement will not significantly increase since the consumed amount of the sample is small. A complete mass spectrum can be obtained even if only a small amount of sample is originally available.

BRIEF DESCRIPTION OF THE DRAWINGS

FIG. 6A is a zero-turn time-of-flight spectrum, while FIG. 6B is a time-of-flight spectrum obtained when the gate electrode was opened at T=200 μs after ions made one or more turns in the loop orbit.

BEST MODE FOR CARRYING OUT THE INVENTION

Figure 1:
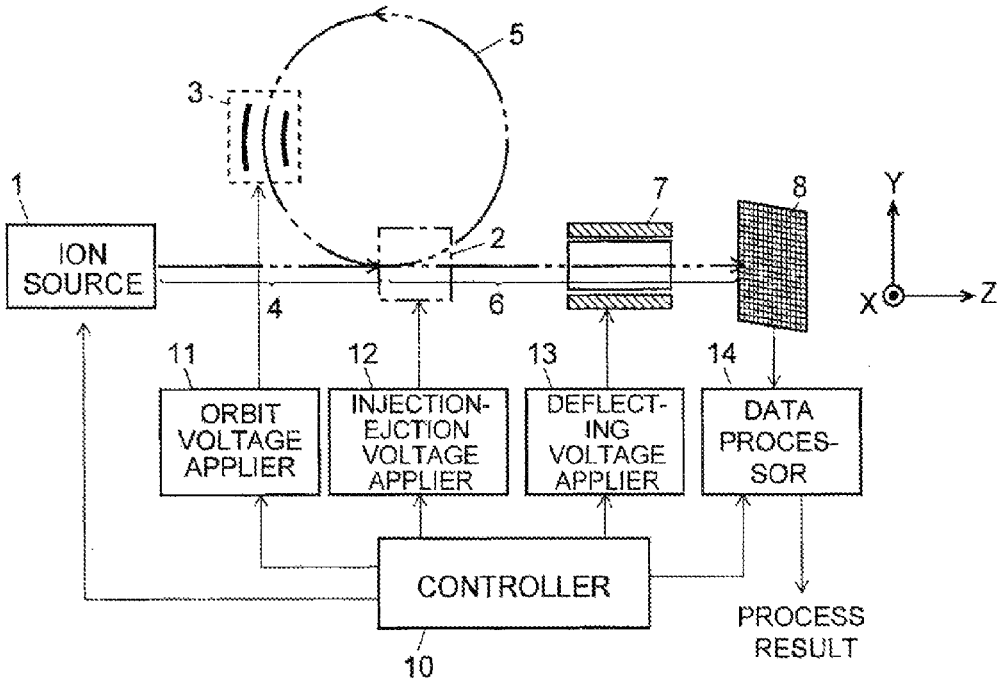
FIG. 1 is a schematic configuration diagram of an MT-TOFMS as one embodiment of the present invention.
Figure 2:
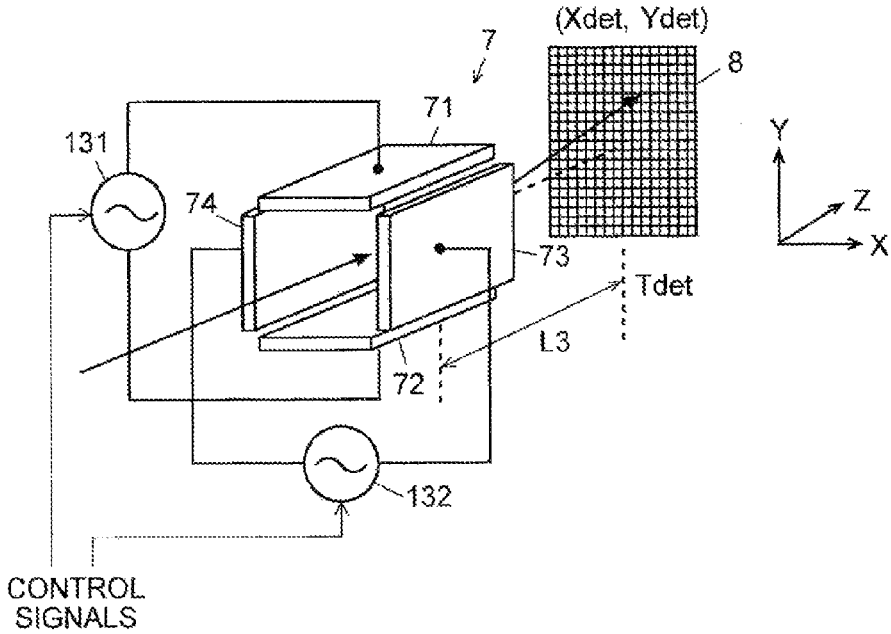
FIG. 2 is a configuration diagram of an ion-deflecting unit in the MT-TOFMS of the present embodiment.

A multi-turn time-of-flight mass spectrometer (MT-TOFMS) as one embodiment of the mass spectrometer according to the present invention is hereinafter described with reference to the attached drawings. FIG. 1 is a schematic configuration diagram of the MT-TOFMS of the present embodiment, and FIG. 2 is a configuration diagram of an ion-deflecting unit in the MT-TOFMS of the present embodiment.

The ion source 1 is, for example, an ion trap for temporally holding a variety of ions produced by an ionization unit (not shown). After being temporally held by the ion source 1, the ions are equally given a predetermined amount of energy at time T=0 and thereby ejected in the form of a packet. The ions included in this packet initially fly along an injection path 4 of length Lin until they reach a gate electrode 2 located on a loop orbit 5. The gate electrode 2 creates an electric field, which makes ions fly along a curved path and be introduced into the loop orbit 5. The loop orbit 5 is formed by a set of electric fields created by applying a voltage from an orbit voltage applier 11 to each of a plurality of pairs of sector-shaped electrodes 3. (Only one pair is shown in FIG. 1 to prevent the drawing from being complex.) A voltage is applied from an injection-ejection voltage applier 12 to the gate electrode 2 to create an electric field for introducing ions from the injection path 5 into the loop orbit 5 or, conversely, deviating ions from the loop orbit 5 into the ejection path 6. While the ions are flying along the loop orbit 5, the gate electrode 2 is virtually non-existent.

When the gate electrode 2 is opened, the ions flying along the loop orbit 5 deviate from this orbit 5 and enter the ejection path 6 of length Lout. On this ejection path 6, a deflector 7 having two pairs of deflecting electrodes are provided, with one pair opposing each other in the Y direction (as denoted by numerals 71 and 72 in FIG. 2) and the other pair opposing each other in the X direction (as denoted by numerals 73 and 74). These two directions are orthogonal to each other as well as to the traveling direction of the ions along the ejection path 6 (the Z direction). A deflecting-voltage applier 13 applies voltages to the deflecting electrodes to create an electric field in the deflector 7. This electric field makes each ion fly along a curved path and impinge on a two-dimensional detector 8 having detector elements which are two-dimensionally arrayed in the X and Y directions.

One example of the two-dimensional detector 8 is a detector provided with a micro-channel plate having an array of detector elements combined with delay-line anodes. Other examples include a backgammon-type ion chamber consisting of a single detector capable of two-dimensional detection, and a position-sensitive parallel-plate detector. If the curving of the trajectory of the ions due to the effect of the deflecting electric field occurs in only one direction, a one-dimensional detector may be used instead of the two-dimensional type. One example of the one-dimensional detectors is a detector provided with a one-dimensional micro-channel plate having a linear array of detector elements combined with delay-line anodes. Another example is a position-sensitive proportional counter consisting of a single detector capable of one-dimensional detection.

The two-dimensional detector 8 detects ions which sequentially arrive at the detector with the lapse of time. Each detector element independently produces a detection signal corresponding to the amount of incident ions. Therefore, with this two-dimensional detector 8, it is possible to obtain information relating to the arrival position of an ion on the detection surface as well as information relating to the arrival time (Tdet) and the amount (or strength) of the incoming ions. The information relating to the arrival position of an ion on the detection surface is hereinafter represented by the address (Xdet, Ydet) of a detector element in the X and Y directions.

The detection signals produced by the two-dimensional detector 8 with the lapse of time from the point of ejection of the ion from the ion source 1 are fed to the data processor 14. In the data processor 14, the signals received from the two-dimensional detector 8 are digitized. Then, as will be described later, the number of turns of each incoming ion is deduced on the basis of the arrival time Tdet and arrival position (Xdet, Ydet) of the ion, the flight distance of the ion is computed from the deduced number of turns, and the time-of-flight is converted to a correct mass-to-charge ratio. Thus, the mass-to-charge ratios of all the detected ions are calculated to create a mass spectrum. The controller 10 controls the components of the system to perform the measurement for the target sample one time or a plurality of times and create a mass spectrum based on the data obtained by the measurement.

Many of the functions of the data processor 14 and the controller 10 can be realized by running a dedicated processing and controlling software program previously installed in a general-purpose personal computer.

As already explained, while ions are flying on the loop orbit 5, faster ions (having small mass-to-charge ratios) overtake slower ions (having large mass-to-charge ratios). Therefore, various ions having different mass-to-charge ratios are mixed together in the loop orbit 5. This situation is the same when the gate electrode 2 is opened and the ions fly on the ejection path 6. If the number of turns of an ion is unknown, it is impossible to calculate its mass-to-charge ratio from its time of flight. To address this problem, the MT-TOFMS of the present embodiment deduces the number of turns of each ion by using a principle to be hereinafter described by means of FIGS. 3A and 3B, which are an explanatory graph illustrating the principle of deducing the number of turns.

Figure 3A:
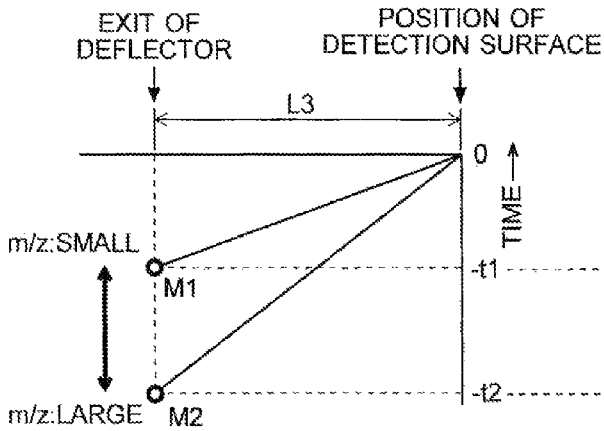
FIGS. 3A and 3B are an explanatory graph illustrating the principle of deducing the number of turns in the MT-TOFMS of the present embodiment.
Figure 3B:
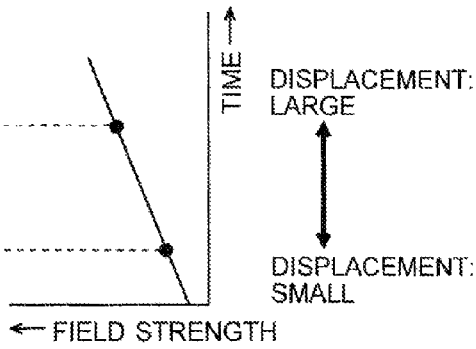

More specifically, FIG. 3A shows the relationship between the mass-to-charge ratio of the ion and the time in the space between the exit end of the deflector 7 and the detection surface of the two-dimensional detector 8, and FIG. 3B shows the temporal change in the strength of the deflecting electric field in the deflector 7. Suppose that two ions having different mass-to-charge ratios (m/z) have simultaneously arrived at the detection surface of the two-dimensional detector 8 at time "0" shown in FIG. 3A. (M1 denotes one ion having a smaller m/z value and M2 denotes the other ion having a larger m/z value.) If the ion M1, which has the smaller m/z value and flies faster, passed through the deflector 7 at time −t1, which is earlier than time "0", the other ion M2 must have passed through the deflector 7 at an even earlier time −t2. The larger the difference in the mass-to-charge ratio between the ions M1 and M2 is, the larger the difference between −t2 and −t1 becomes. When the deflecting electric field in the deflector 7 is controlled so that its strength increases with time as shown in FIG. 3B, the later-passing ion M1 is more strongly affected by the electric field than the earlier-passing ion M2. This means that the ion M1 having a smaller mass-to-charge ratio undergoes a larger displacement due to the electric field than the ion M2 having a larger mass-to-charge ratio. Therefore, even if the ions M1 and M2 simultaneously arrive at the detection surface of the two-dimensional detector 8, the arrival positions of these ions are separated from each other in the direction of their displacement.

As just described, when different kinds of ions simultaneously impinge on the detection surface, the points of arrival of the ions on the detection surface vary according to their mass-to-charge ratios. The amount of the positional shift of an ion arriving at the detection surface after passing though the deflecting electric field (i.e. the amount of displacement) depends on the strength of the deflecting electric field at the moment when the ion passes through this field. The strength of this electric field is determined by the voltages applied to the deflector 7 (i.e. the deflecting electrodes 71-74). Therefore, as will be described later, the amount of displacement is a time-dependent value, provided that the voltages applied to the deflector 7 change in a known manner from a specific point in time, e.g. from when the gate electrode 2 is opened. Furthermore, as shown in FIG. 2, when the deflecting electric fields are created in two directions X and Y, the direction of the displacement is determined by the ratio between the strengths of the two electric fields. The amount and direction of the displacement can be expressed by the address (Xdet, Ydet) of a detector element on the detection surface of the two-dimensional detector 8. Therefore, the time (Tdeflect) at which an ion passed through the deflector 7 can be deduced from the address (Xdet, Ydet) of the detector element at which the ion has arrived. The flight speed of the ion can be calculated from the difference between the time Tdeflect and the time Tdet at which the ion actually arrived at the two-dimensional detector 8, and the distance L3 between the deflector 7 and the two-dimensional detector 8. Given the flight speed of the ion, it is possible to roughly estimate the number of turns of the ion from the calculated flight speed and the measured time of flight.

As described thus far, in the MT-TOFMS of the present embodiment, the number of turns of an ion can be roughly determined based on the information relating to the position and time of arrival of the ion on the detection surface of the two-dimensional detector 7 when a temporally varying voltage is applied to the deflector 7 to deflect the passing ion.

Figure 4:
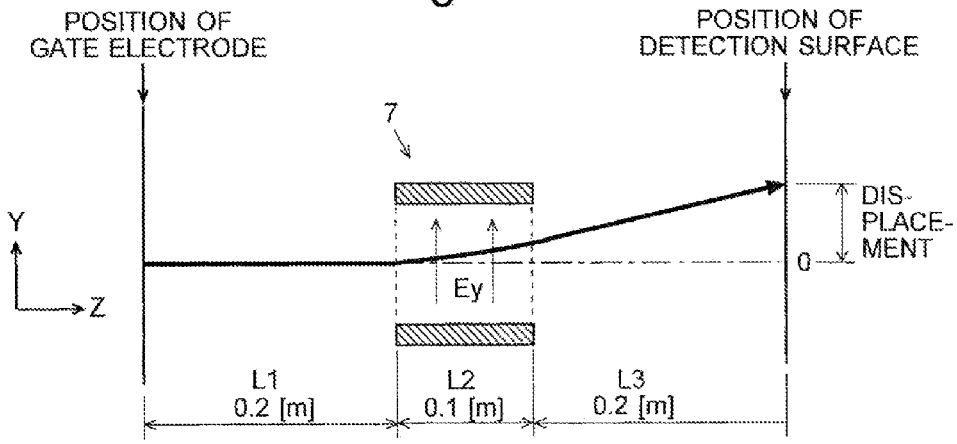
FIG. 4 is a schematic diagram showing a model used in a computer simulation of the operation of the ion-deflecting unit in the MT-TOFMS of the present embodiment.
Figure 5:
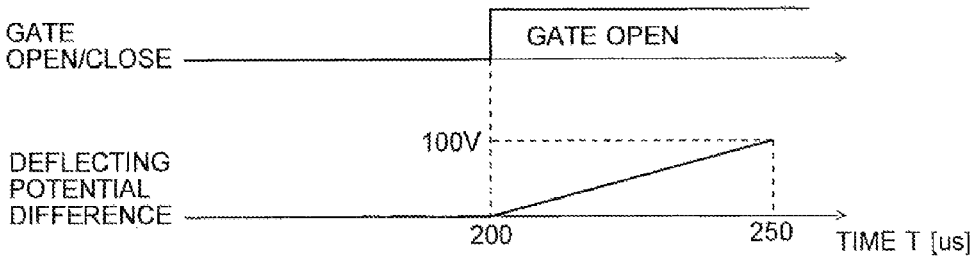
FIG. 5 is a timing chart of a signal supplied to the simulated system.

The result of a computer simulation, which was conducted to verify that the number of turns can be deduced in the previously described manner, is hereinafter described by means of FIGS. 4 and 5. FIG. 4 shows the model of components arranged along the ejection path used in the simulation, and FIG. 5 is a timing chart of the signals used in the simulation. This simulation was performed under the conditions that the length of the injection path 4 was Lin=0.5 m, the path length of one turn of the loop orbit 5 was Lturn=1 m, and the length of the ejection path 6 was Lout=0.5 m. The length of the gate electrode 2 was ignored for ease of computation. As the deflector 7, a pair of deflecting electrodes having a length of L1=0.1 m in the Z direction and facing each other with a gap of 10 mm were provided in the middle of the ejection path 6 (at L1=L3=0.2 m) to create a one-dimensional electric field. Under this setting, the displacement of ions occurs only in the Y direction. The ion source 1 had an accelerating energy of 7 kV at the ejection of the ions and was controlled so that 31 kinds of ion groups with the mass-to-charge ratios ranging from 500 Da to 2000 Da in steps of 50 Da were collectively ejected at time T=0. After the ions underwent a plurality of turns through the loop orbit 5, the gate electrode 2 was opened at time Tx=200 μs to send them into the ejection path 6. Meanwhile, as shown in FIG. 5, a saw-tooth voltage, which began to rise simultaneously with the opening of the gate electrode 2 (at Tx=200 μs), was applied to the deflecting electrodes. The changing rate of the voltage applied between the deflecting electrodes was 100 V/50 μs.

Figure 6A:
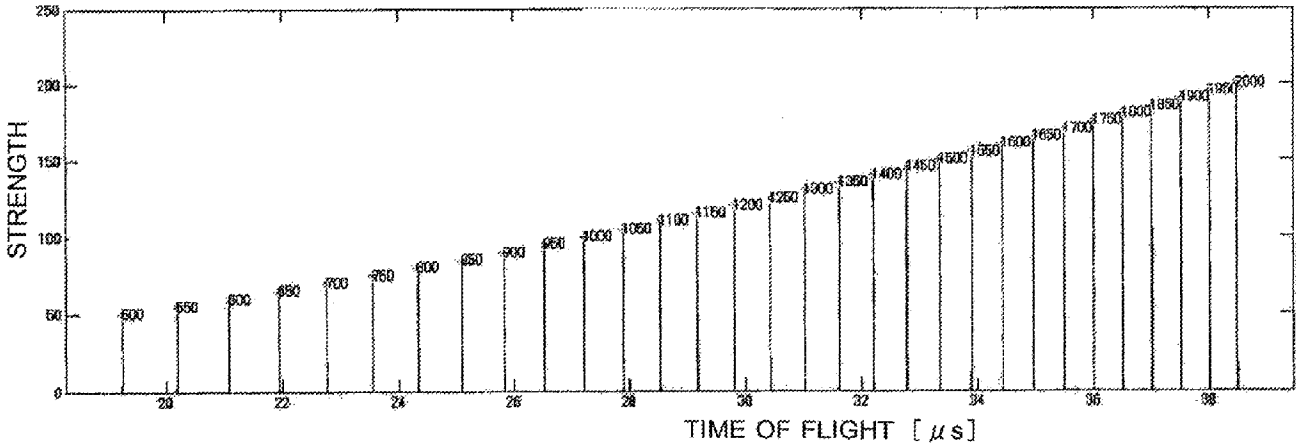
FIGS. 6A and 6B are time-of-flight spectra obtained by a computer simulation under the condition that the width of the ion packet is 2 ns; specifically.
Figure 6B:
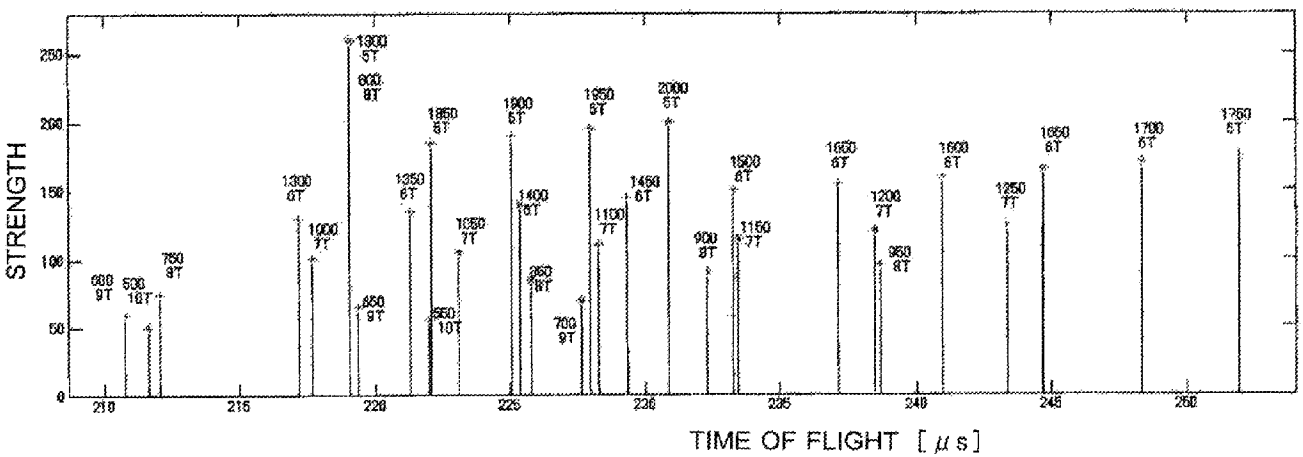

FIGS. 6A and 6B show time-of-flight spectra obtained by the computer simulation under the condition that each packet of ions having the same mass-to-charge ratio had a width of 2 ns. Specifically, FIG. 6A shows a zero-turn time-of-flight spectrum obtained under the condition that the ions were directly sent from the injection path 4 to the ejection path 6, bypassing the loop orbit 5, and detected the two-dimensional detector 8. The numerical values in the figure denote the mass-to-charge ratios of the ions. The strength of each ion was determined within the range from 50 to 200 in steps of 5. The mass resolving power was approximately 9860.

FIG. 6B is a time-of-flight spectrum obtained under the condition that, after the ions were introduced into the loop orbit 5, the gate electrode 2 was opened at Tx=200 μs, with no deflecting electric field created. The mass-to-charge ratios and number of turns of the ions are numerically shown for reference, although these numerical values are actually unknown. From FIG. 6B, it can be understood that, although the mass resolving power has improved to 63,500 as a result of making the ions fly through the loop orbit 5 a plurality of times, the time-of-flight spectrum cannot be directly converted to the mass spectrum due to the overtaking of the ions. It should also be noted that the peak of 800 Da (eight turns) and that of 1,800 Da (five turns) accidentally overlap each other. Such an overlapping of the peaks not only deteriorates the accuracy of the conversion from the time-of-flight spectrum to the mass spectrum but also makes it difficult to assign the peaks (i.e. to deduce the kind or mass-to-charge ratio of the ions from which the peaks have originated).

Figure 7:
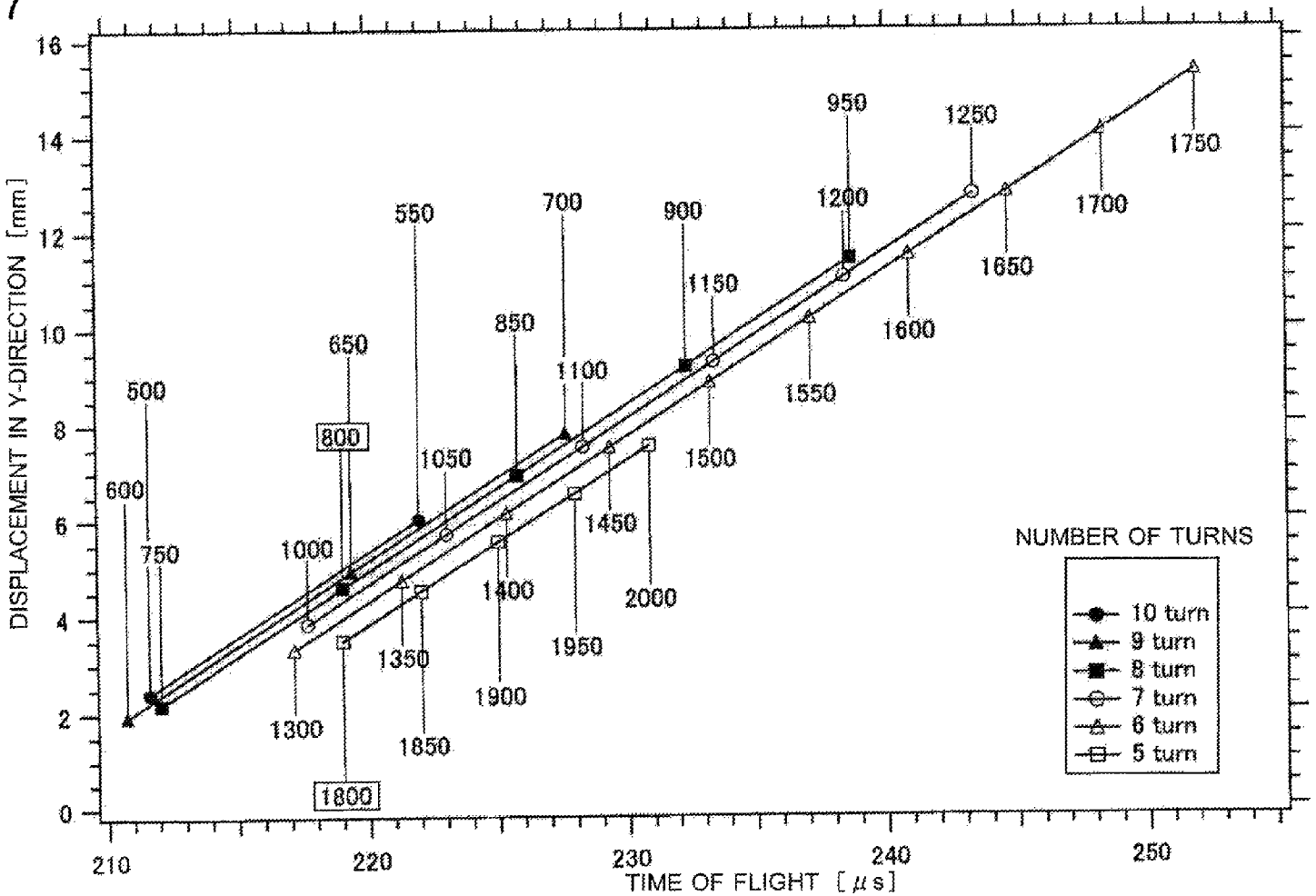
FIG. 7 is a chart showing the relationship between the time of flight and the amount of displacement in the Y direction on the detector under the condition that a deflecting voltage was applied as shown in FIG. 5.

FIG. 7 is a chart showing the result of a calculation of the relationship between the times of flight of various kinds of ions and the amounts of displacement in the Y direction (i.e. the amount of shift of the arrival position Of each ion on the detection surface of the two-dimensional detector 8) in the case where the temporally varying voltage shown in FIG. 5 was applied to the deflecting electrodes. On this chart, the ions of 800 Da and 1,800 Da, which overlapped each other on the conventional time-of-flight spectrum shown in FIG. 6B and had almost the same time of flight, can be unmistakably identified as two ions detected at different positions on the detection surface of the two-dimensional detector 8. Ions having the same number of turns exactly lie on the same line, regardless of their mass-to-charge ratios. The lines, each of which corresponds to a different number of turns, are clearly separated and do not overlap each other. Therefore, the deduction of the number of turns from the amount of displacement can be easily achieved even if the measurement is performed only one time.

The lines shown in FIG. 7 can be regarded as a type of calibration curves for determining the number of turns from the time of flight and the amount of displacement in the Y direction. Such a relationship can be determined by a preliminary measurement and compiled into a certain form of calibration information, such as formulae or tables, to be stored in the data process 14. This calibration information can be used to determine the number of turns corresponding to a time of flight and an amount of displacement in the Y direction obtained in the measurement of an unknown sample.

An example of the analytical operation characteristic of the MT-TOFMS of the present embodiment using the previously described principle is hereinafter described.

In the present MT-TOFMS, ions are collectively ejected from the ion source 1 at time T=0. After the ejected ions are introduced through the gate electrode 2 into the loop orbit 5, the gate electrode 2 is opened at time T=Tx (which is hereinafter called the "gate-opening time") to introduce the ions into the ejection path 6. As already explained, if the gate-opening time Tx is later than a certain time, i.e. if the ions continue flying in the loop orbit 5 for a relatively long period of time, an ion having a low mass-to-charge ratio will overtake another ion having a high mass-to-charge ratio during the flight, so that two or more ions that have undergone different numbers of turns through the loop orbit 5 will be mixed on the ejection path 6. In order to obtain the number-of-turns necessary for calculating the mass-to-charge ratio for each of the ions having different mass-to-charge ratios, a voltage that is not constant but varies with time is applied from the Y-directional deflecting voltage applier 131 and the X-directional deflecting voltage applier 132 of the deflecting-voltage applier 13 to each of the two pairs of deflecting electrodes 71-74 of the deflector 7. The voltages respectively applied from the Y-directional and X-directional deflecting voltage appliers 131 and 132 are synchronized with each other and yet have different voltage values.

The initiation of the temporal change of the deflecting voltage is synchronized, for example, with the beginning of the flight (T=0) or the opening of the gate electrode 2 (T=Tx). The example of FIG. 5 is the latter case; the deflecting voltage is linearly increased from T=Tx. The electric fields created in the space inside the deflecting electrodes 71-74 by the applied voltages are respectively oriented in the X and Y directions shown in FIGS. 1 and 2 and perpendicular to the central axis of the flying direction of the incoming ions (the Z direction shown in FIGS. 1 and 2). Such deflecting electric fields have no effect on the motion of the ions in the Z direction and hence no effect on the time of flight of the ions.

As already explained, the ions are deflected from their original path due to the effect of the deflecting electric field in the deflector 7. The amount of deflection corresponds to the strength of the electric field (i.e. the magnitude of the applied voltage). The deflecting direction of the ions depends on the ratio between the strengths of the electric fields in the X and Y directions. Therefore, as already explained, if two or more ions simultaneously impinge on the two-dimensional detector 8, they will arrive at different positions on the detection surface of the two-dimensional detector 8 according to their mass-to-charge ratios. In the two-dimensional detector 8, each detector element produces a detection signal whose intensity changes with time corresponding to the amount of incident ions. The detection signal is sent to the data processor 14, which processes this signal to extract information relating to the time, position and intensity, estimates the flight speed of each of the incident ions, and roughly calculates the number of turns of the ion from the estimated flight speed. If, as described previously, the relation of the number of turns to the time of flight and the amount of displacement (positional information) is previously determined and compiled into calibration information, it is possible to directly determine the number of turns without estimating the flight speed.

With the number of turns of an ion thus determined, the flight distance from the ion source 1 to the two-dimensional detector 8 can be definitely determined. Using this value, the data processor 14 calculates the mass-to-charge ratio from the time of flight determined from the arrival time of the ion. In this manner, a highly accurate mass spectrum can be eventually obtained by roughly determining the number of turns of each ion on the basis of the detection signal received from the two-dimensional detector 8 with the lapse of time and calculating the mass-to-charge ratio by using the determined number of turns.

In the system of the present embodiment, if there is an ion passing through the gate electrode 2 at the moment of opening the gate electrode 2 to introduce ions flying along the loop orbit 5 into the ejection path 6, the ion may possibly be disturbed during its flight and lost, which means that the ion cannot reach the two-dimensional detector 8. Therefore, a mass spectrum that is created based on the result of only one measurement performed for one sample may be missing a peak corresponding to an ion that has been lost in the previously described way. This problem can be avoided by performing the measurement for the same sample at least two times with the gate-opening time Tx set at different points in time, creating a mass spectrum for each measurement, and integrating the resulting mass spectra into one mass spectrum in which any missing ion is compensated for.

As already explained, the position at which the ions impinge on the detection surface of the two-dimensional detector 8 changes depending on the deflecting electric field created by the deflector 7 (the electric fields in the X and Y directions in the case of FIG. 2). In the MT-TOFMS of the previous embodiment, it is possible to vary the trajectory of the ions so that the point of arrival of the ions on the detection surface of the two-dimensional detector 8 will move in a specific pattern with the lapse of time, i.e. so that the point of arrival of the ions will describe a specific locus, by appropriately setting the voltage applied from the Y-directional deflecting voltage applier 131 to the pair of the deflecting electrodes 71 and 72 as well as the voltage applied from the X-directional deflecting voltage applier 132 to the other pair of the deflecting electrodes 73 and 74. FIGS. 8A-8D illustrate such examples.

Figure 8A:
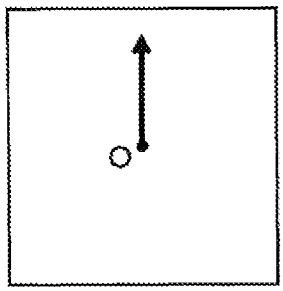
FIGS. 8A-8D are examples of the locus of the point of arrival of the ions on the detection surface of a two-dimensional detector.
Figure 8B:
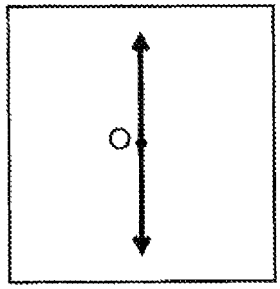

If no voltage is applied from the X-directional deflecting voltage applier 132 to the deflecting electrodes 73 and 74 while a voltage as shown in FIG. 5 is applied from the Y-directional deflecting voltage applier 131 to the deflecting electrodes 71 and 72, the locus of the point of arrival of the ions will be limited on a half-line extending from the initial position (central position) O along the Y direction, as shown in FIG. 8A. If no voltage is applied from the X-directional deflecting voltage applier 132 to the deflecting electrodes 73 and 74 while a voltage swinging back and forth is applied from the Y-directional deflecting voltage applier 131 to the deflecting electrodes 71 and 72, the point of arrival of the ions will describe a linear locus extending from the initial position (central position) O to both sides along the Y direction, as shown in FIG. 8B.

Figure 8C:
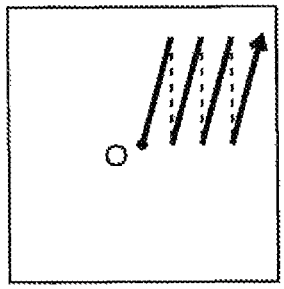
Figure 8D:
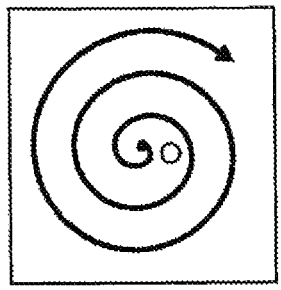
Figure 8D:
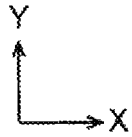

If a saw-tooth voltage which changes rather slowly as shown in FIG. 5 is applied from the X-directional deflecting voltage applier 132 to the deflecting electrodes 73 and 74 while a saw-tooth voltage which changes at a rate that is a few to ten times higher than the aforementioned slow-changing voltage (and with a period as much shorter) is applied from the Y-directional deflecting voltage applier 131 to the deflecting electrodes 71 and 72, the point of arrival of the ions will roughly describe a saw-tooth locus, as shown in FIG. 8C. The changing rate of the temporally varying voltage applied to the deflecting electrodes does not need to be constant; the voltage may have any waveform as long as the point in time at which an ion passed through the deflector 7 can be determined definitely (and easily, if possible) from the position on the detection surface of the two-dimensional detector 8. For example, as shown in FIG. 8D, the point of arrival of the ions will describe a spiral line if the applied voltages are controlled so that the strengths of the X and Y directional electric fields are proportional to sine and cosine, respectively, and the proportional coefficient increases or decreases with time. The movement of the point of arrival of the ions does not need to start from the central point O or end at this point. For example, the locus may be a Lissajous figure, such as a circular or elliptic shape.

As can be understood from FIG. 7, for a group of ions having the same time of flight, if the overall displacement is small, the number of turns of each ion is difficult to determine. To facilitate the determination of the number of turns, or to improve the accuracy of the determination of the number of turns, it is preferable to make the overall displacement as large as possible, i.e. to make the locus of the point of arrival of the ions as long as possible. In this sense, it is more advantageous to deflect ions in two directions, as in the examples of FIGS. 8C and 8D, rather than deflecting them only in one direction of X or Y.

The previous embodiment is a mere example of the present invention, and any change, modification or addition appropriately made within the spirit of the present invention will be naturally included in the scope of claims of this patent application.

For example, although the previous embodiment is an example in which the present invention is applied to a mass spectrometer in which ions are made to fly along almost the same loop orbit a plurality of times, it is evident that the present invention can also be applied to a multi-reflection time-of-flight mass spectrometer in which a pair of reflectrons are arranged opposite to each other.

EXPLANATION OF NUMERALS

1 . . . Ion Source
2 . . . Gate Electrode
3 . . . Sector-Shaped Electrode
4 . . . Injection Path
5 . . . Loop Orbit
6 . . . Ejection Path
7 . . . Deflector
71, 72, 73, 74 . . . Deflecting Electrode
8 . . . Two-Dimensional Detector
10 . . . Controller
11 . . . Orbit Voltage Applier
12 . . . Introduction-Ejection Voltage Applier
13 . . . Deflecting Voltage Applier
131 . . . Y-Directional Deflecting Voltage Applier
132 . . . X-Directional Deflecting Voltage Applier
14 . . . Data Processor

The invention claimed is:

1. A multi-turn time-of-flight mass spectrometer for determining a mass-to-charge ratio of an ion from a time of flight of the ion by ejecting ions in a pulsed fashion from an ion source, introducing the ejected ions into a loop-orbit section to make the ions repeatedly fly along a substantially identical orbit a plurality of times, detecting each of the ions deviated from the loop-orbit section, and determining the time of flight of the detected ion, the mass spectrometer comprising:

a) a deflecting electrode unit located on a path extending from a point at which the ions deviate from the loop-orbit section to a below-mentioned ion detector;

b) a voltage generator for applying a temporally varying voltage to the deflecting electrode unit to create an electric field having an effect of shifting an ion in a direction orthogonal to an incident direction of the ions entering the deflecting electrode unit;

c) an ion detector for providing at least positional information indicating an arrival position of the ion in the direction in which the ion is shifted by the electric field created by the deflecting electrode unit, and temporal information indicating an arrival time of the ion; and d) a data processor for deducing a number of turns made by an ion in the loop-orbit section, based on the positional information indicating the arrival position of the ion at the ion detector and the temporal information indicating the arrival time of the ion, and for calculating the mass-to-charge ratio of the ion by using information indicating the deduced number of turns.

2. The multi-turn time-of-flight mass spectrometer according to claim 1, wherein the deflecting electrode unit includes two sets of electrodes capable of deflecting an ion in two directions orthogonal to each other as well as orthogonal to an incident direction of the ion entering the deflecting electrode unit; the voltage generator applies a temporally varying voltage to each of the two sets of electrodes; and the ion detector includes a plurality of detector elements which are two dimensionally arrayed in the aforementioned two directions.

3. The multi-turn time-of-flight mass spectrometer according to claim 2, wherein the voltage generator generates two voltages whose waveforms temporally vary with different periods, and applies the voltages to the two sets of the deflector electrodes, respectively.

4. A method of performing multi-turn time-of-flight mass spectrometry for determining a mass-to-charge ratio of an ion from a time of flight of the ion, comprising:

ejecting ions in a pulsed fashion from an ion source;

introducing the ejected ions into a loop-orbit section to make the ions fly along a substantially identical orbit a plurality of times;

opening a gate electrode to allow the ions to deviate from the loop-orbit to enter into a deflecting electrode unit, which is located on a path extending from a point at which the ions deviate from the loop-orbit section to an ion detector;

applying temporally varying voltages with a voltage generator to the deflecting electrode unit to create an electric field having an effect of shifting the ions in a direction orthogonal to an incident direction of the ions entering the deflecting electrode unit;

detecting each of the ions deviated from the loop-orbit section with an ion detector to provide at least positional information indicating an arrival position of each ion in the direction in which the ion is shifted by the electric field created by the deflecting electrode unit, and temporal information indicating an arrival time of the ion;

deducing with a data processor a number of turns made by the ion in the loop-orbit section, based on the positional information indicating the arrival position of the ion at the ion detector and the temporal information indicating the arrival time of the ion; and calculating the mass-to-charge ratio of the ion by using information indicating the deduced number of turns.

5. The method according to claim 4, wherein the deflecting electrode unit includes two sets of electrodes capable of deflecting an ion in two directions orthogonal to each other as well as orthogonal to an incident direction of the ion entering the deflecting electrode unit; the voltage generator applies a temporally varying voltage to each of the two sets of electrodes; and the ion detector includes a plurality of detector elements which are two dimensionally arrayed in the aforementioned two directions.

6. The method according to claim 5, wherein the voltage generator generates two voltages whose waveforms temporally vary with different periods, and applies the voltages respectively to the two sets of the deflector electrodes.

7. A method of performing multi-turn time-of-flight mass spectrometry for determining a mass-to-charge ratio of an ion from a time of flight of the ion, comprising:

ejecting ions in a pulsed fashion;

circulating the ejected ions in a loop-orbit;

allowing the ions to deviate from the loop-orbit to enter into a deflecting electrode unit, which is located on a path extending from a point at which the ions deviate from the loop-orbit to an ion detector;

applying varying voltages to the deflecting electrode unit to create an electric field for shifting the ions in a direction orthogonal to an incident direction of the ions entering the deflecting electrode unit;

detecting each of the ions deviated from the loop-orbit to provide at least positional information indicating an arrival position of each ion in the direction in which the ion is shifted by the electric field, and temporal information indicating an arrival time of the ion;

deducing a number of turns made by the ion in the loop-orbit, based on the positional information indicating the arrival position of the ion and the temporal information indicating the arrival time of the ion; and calculating the mass-to-charge ratio of the ion by using information indicating the deduced number of turns.

8. The method according to claim 7, wherein the deflecting electrode unit includes two sets of electrodes capable of deflecting an ion in two directions orthogonal to each other as well as orthogonal to an incident direction of the ion entering the deflecting electrode unit.

9. The method according to claim 8, wherein the varying voltages are applied to each of the two sets of electrodes.

10. The method according to claim 8, wherein the detecting step employs the ion detector with a plurality of detector elements which are two dimensionally arrayed in the aforementioned two directions.

11. The method according to claim 8, wherein applying the varying voltages employs a voltage generator for generating two voltages whose waveforms temporally vary with different periods, and applies the voltages respectively to the two sets of the deflector electrodes.

* * * * *